United States Patent [19]

Shimura et al.

[11] Patent Number: 4,833,021

[45] Date of Patent: May 23, 1989

[54] NON-IMPACT ELECTROTHERMIC RECORDING MATERIAL

[75] Inventors: Ryochi Shimura, Susono; Yukio Konagaya, Shizuoka, both of Japan

[73] Assignee: Ricoh Company Ltd., Tokyo, Japan

[21] Appl. No.: 157,796

[22] Filed: Feb. 19, 1988

[30] Foreign Application Priority Data

Feb. 20, 1987 [JP] Japan ..... 62-39520
Jul. 31, 1987 [JP] Japan ..... 62-191979
Jan. 11, 1988 [JP] Japan ..... 63-4270

[51] Int. Cl.[4] ..... B41M 5/26

[52] U.S. Cl. ..... 428/336; 400/120; 428/195; 428/207; 428/209; 428/337; 428/346; 428/349; 428/354; 428/457; 428/458; 428/474.4; 428/484; 428/488.4; 428/913; 428/914

[58] Field of Search ..... 428/195, 209, 484, 488.1, 428/488.4, 913, 914, 346, 349, 354, 355, 207, 216, 336, 337, 457, 458, 474.4; 400/120

[56] References Cited

U.S. PATENT DOCUMENTS 4,477,198 10/1984 Bowlds et al. ..... 428/913
4,775,578 10/1988 Hayashi et al. ..... 428/484

*Primary Examiner*—Ellis P. Robinson
*Assistant Examiner*—P. R. Schwartz
*Attorney, Agent, or Firm*—Oblon, Fisher, Spivak, McClelland & Maier

[57] ABSTRACT

A non-impact electrothermic image transfer recording material is disclosed, which comprises an electroconductive resin film support, on which a metal film layer, a thermofusible peel-off layer, a thermofusible ink layer, and an adhesive layer are successively overlaid.

9 Claims, 1 Drawing Sheet

NON-IMPACT ELECTROTHERMIC RECORDING MATERIAL

BACKGROUND OF THE INVENTION

The present invention relates to a non-impact electrothermic recording material, and more particularly to a nonimpact electrothermic image transfer recording material for use with noiseless typewriters, computer output apparatus and facsimile apparatus.

Conventionally, a variety of non-impact electrothermic recording materials have been proposed.

For example, in U.S. Pat. No. 4,103,066, there is proposed a recording material in the shape of a non-impact printing ribbon consisting of an image transfer layer and an electrically resistant layer comprising polycarbonate resin and electroconductive carbon black. This recording material, however, has the shortcoming that the polycarbonate resin employed in the electrically resistant layer has a thermally deforming temperature as low as 120° C. to 130° C., so that part of the resin is melted and adheres to the styli of a recording electrode during recording operation and eventually the quality of printed images is degraded and the life of the styli is shortened.

In Japanese Laid-Open Patent Application 56-93585, there is proposed a recording material consisting of a support having a thickness of about 5 μm, made of expensive stainless steel, or an aluminum layer having a thickness of 0.1 μm, which serves as an electroconductive layer as well, an electrically resistant layer formed on the support, which consists of a resin film comprising electroconductive carbon and a resin in which the electroconductive carbon is dispersed, and a layer of Si-O/Cr, SiCo, or $Al_2O_3$ formed on the resin film, and an image transfer layer formed on the electrically resistant layer. This recording material has the shortcoming that the quality of dots is not good.

In U.S. Pat. No. 4,536,437, there is proposed a three-layered type non-impact electrothermic image transfer recording material which comprises a base layer (electrically resistant layer), an intermediate layer and an ink layer. Since the intermediate layer comprises a resin component and carbon, it is difficult to decrease the electric resistivity of the intermediate layer. Therefore the necessary voltage for recording is as high as 100 to 200 V.

The above-mentioned non-impact electrothermic image transfer recording materials have the common shortcoming that the quality of printed images is easily affected by the surface smoothness of a recording sheet, so that it is difficult to obtain dots in good shape when a recording sheet having a rough surface is employed.

SUMMARY OF THE INVENTION

It is therefore an object of the present invention to provide a non-impact electrothermic image transfer recording material which has high mechanical strength and high heat resistance and is capable of yielding images with excellent image fixing property, which is scarcely affected by the surface smoothness of a recording sheet.

Another object of the present invention is to provide a non-impact electrothermic image transfer recording material capable of yielding images by use of a relatively small amount of thermal recording energy, whereby it is possible to drive a non-impact electrothermic printer with a low voltage and to lengthen the life of the recording styli thereof.

The above objects of the present invention can be achieved by a non-impact electrothermic image transfer recording material comprising an electroconductive resin film support, a metal film layer formed on the electroconductive resin film support, a thermofusible peel-off layer formed on the metal film layer, a thermofusible ink layer formed on the thermofusible peel-off layer, and an adhesive layer formed on the thermofusible ink layer.

The non-impact electrothermic image transfer recording material according to the present invention has the advantages over the conventional non-impact electrothermic image transfer recording materials that electrothermic recording can be carried out by use of a relatively small quantity of recording energy and the quality of printed images is hardly affected by the smoothness of a recording sheet so that even if a recording sheet is not smooth, dots and images can be formed flawlessly.

This non-impact electrothermic image transfer recording material may be used in the same manner as conventional non-impact electrothermic image transfer recording materials. For example, the recording material is superimposed on a recording sheet and a recording electrode and a return electrode are placed in contact with the recording material, and image-delineating signal voltage is applied across the recording material through the recording electrode and the return electrode, so that an ink is transferred imagewise from the recording material to the recording sheet.

DETAILED DESCRIPTION OF THE PREFERRED EMBODIMENTS

An embodiment of a non-impact electrotheric image transfer recording material according to the present invention will now be explained with reference to the accompanying drawing.

Figure 1:
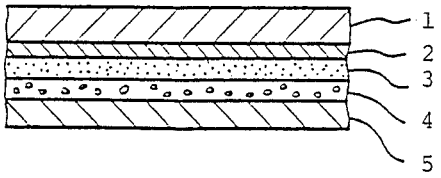
FIG. 1 is an enlarged schematic cross-sectional view of an embodiment of a non-impact electrothermic image transfer recording material according to the present invention.

In FIG. 1, reference numeral 1 indicates an electroconductive resin film support, and reference numeral indicates a metal film layer which is formed on the electroconductive resin film support. Reference numeral 3 indicates a thermofusible peel-off layer. Reference numeral 4 indicates a thermofusible ink layer which is formed on the thermofusible peel-off layer 3, and reference numeral 4 indicates an adhesive layer which is formed on the thermofusible ink layer 3.

In the present invention, as the electroconductive resin film support 1, a resin film containing an electroconductive material such as electroconductive carbon black may be employed. In particular, an electroconductive resin film comprising an aromatic polyamide and an electroconductive carbon black which is dispersed in the polyamide is preferably employed.

As such a polyamide, for example, aromatic polyamides as disclosed in Japanese Laid-Open Patent Application No. 53-35797, having the following general formula, may be employed:

$$\text{-}(\text{NH}-\text{Ar}^1-\text{NHCO}-\text{Ar}^2-\text{CO})_n \text{ or}$$

$$\text{-}(\text{CO}-\text{Ar}^3-\text{NH})_n$$

wherein $Ar^1$, $Ar^2$ and $Ar^3$ each represent an aromatic group having a valence of 2, which may be identical or different. The aromatic groups in the above polyamides may have a substituent of halogen for more solubility in organic solvents and more workability of the polyamides.

Specific representative examples of the aromatic polyamides are poly(m-phenyleneisophthalamide), poly(mphenyleneterephthalamide), poly(p-phenyleneisophthalamide), poly(p-phenyleneterephthalamide), poly(4,4'-oxydiphenyleneterephthalamide), poly(4,4'-oxydiphenyleneisophthalamide), poly(m-benzamide), and poly(p-benzamide). Of these aromatic polyamides, poly(m-phenyleneisophthalamide) and poly(mphenylenetelephthalamide) are particularly useful, because they are very soluble in many solvents, and the solutions of the polyamides with high concentration can be prepared, so that film formation of the polyamides can be easily done by a wet molding method.

As the solvent for the film formation, N,N-dimethylformamide, dimethylacetamide, N-methyl-2-pyrrolidone are particularly suitable.

The metal film layer 2 can be formed on the electroconductive resin film support 1, for example, by the ion sputtering method and ion plating method. For mass production, a conventional vacuum deposition method at $10^{-4}$ to $10^{-5}$ Torr is most suitable.

As the metal film layer 2, an aluminum-deposited layer is preferable for use in the present invention.

Figure 2:
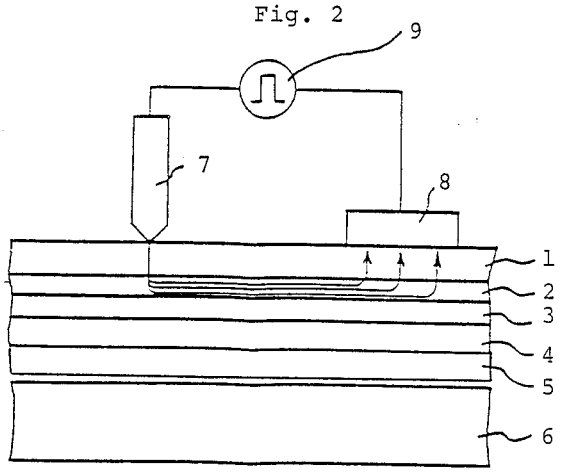
FIG. 2 is a schematic illustration in explanation of an electrothermic recording process by use of the non-impact electrothermic image transfer recording material as shown in FIG. 1.

The thermofusible peel-off layer 3 formed on the metal film layer 2 is fused and loses its mechanical strength when heated, thereby facilitating the peeling of the thermofusible ink layer 4 off the metal film layer 2. The thermofusible ink layer 4 contains a coloring material. When the thermofusible ink layer 4 is heated imagewise, it is softened and transferred to a recording sheet 6 (as shown in FIG. 2) to form a visible image thereon.

The thermofusible peel-off layer 3 comprises a wax which melts at 120° C. or less, more preferably in the range of 60° C. to 110° C., to form a so-called lubricant having a low viscosity when melted, and a resin which is compatible with the melted wax for facilitating the adhesion of the peel-off layer 3 to the metal film layer 2.

Specific preferable examples of the wax for use in the peel-off layer 3 are a natural wax such as candelila wax, carnauba wax, and rice wax; petroleum wax such as paraffin wax, and microcrystalline wax; and a synthetic wax such as polyethylene wax and polypropylene wax. Specific preferable examples of the resin for use in the peel-off layer 3 are ethylene—vinyl acetate copolymer, styrene—butadiene copolymer, ethylene—methacrylate copolymer, xylene resin and ketone resin.

It is essential that the thermofusible peel-off layer 3 not contain a pigment such as carbon black because if such a pigment is contained in the peel-off layer 3, it does not become a liquid having a low viscosity when heated.

The thermofusible ink layer 4 may be composed of the same components as those employed in the thermofusible ink layer of conventional non-impact electrothermic image transfer recording materials. However, it is preferable that the thermofusible ink layer 4 contain more resin components as compared with the content of a resin component in the conventional thermofusible ink layer in order to obtain clear printed images without being affected by the smoothness of the surface of a recording sheet. This is because it is necessary that the thermofusible ink layer 4 maintain a certain mechanical strength, without becoming a low viscosity liquid, when heated. In order to meet this requirement, as the thermofusible ink layer 4, there is employed a layer comprising as the main components a coloring agent and a thermo-softening resin, which is, for example, employed as a binder for a conventional hot-melt adhesive agent, such as styrene resin, ethylere—vinyl acetate copolymer, ethylene—methacrylate or acrylate copolymer, and a polyamide resin. Of these thermosoftening resins, styrene resins having a melting or softening point ranging from 70° C. to 140° C. and a molecular weight ranging from 10,000 to 70,000 are the most preferable resin. In order to improve or adjust the thermosensitivity and image fixing performance of the thermofusible ink layer 4, a lubricant such as waxes and polyethylene wax may be added to the thermofusible ink layer 4.

The adhesive layer 5 is formed on the thermofusible ink layer 4 as shown in FIG. 1. The adhesive layer 5 serves to increasing the binding between the thermofusible ink layer 4 and a recording sheet 6 (as shown in FIG. 2) when images are transferred from the thermofusible ink layer 4 to the recording sheet 6 to improve the image fixing performance of the recording material.

In the adhesive layer 5, thermoplastic resins, preferably thermoplastic resins having a melting or softening point ranging from 70° C. to 140° C., are employed. Specific examples of such thermoplastic resins are acryl resin, methacryl resin, styrene resin, vinyl acetate resin, vinyl chloride resin, vinylidene chloride resin, petroleum resin, novolak resin, olefin resin, polyester resin, polyacetal resin, and copolymers comprising the nonomers of the above resins.

Further the adhesive layer 5 may be composed of at least on thermofusible material selected from the group consisting of phenol derivatives, naphthol derivatives, aromatic carboxylic acid derivatives and fatty acid amide derivatives. Specific examples of such a thermoplastic material are 4-tert-butylphenol (m.p. 98° C.), 4-hydroxydiphenyl ether (m.p. 84° C.), 1-naphthol (m.p. 98° C.), 2-naphthol (m.p. 121), and methyl-4-hydroxybenzoate (m.p. 131).

As a matter of course, the adhesive layer 23 may be composed of any of the above mentioned thermoplastic resins having a melting or softening point ranging from 70° C. to 140° C. and any of the just mentioned thermofusible material in combination.

Further it is preferable that a lubricant be contained in the adhesive layer 5 in an amount of 10 parts by weight or less, more preferably in an amount of 0.5 to 10 parts by weight, to 100 parts by weight of any of the above thermoplastic resins and/or any of the above thermofusible materials. By containing a lubricant in the adhesive layer 5, the coefficient of friction of the electrothermic recording material can be significantly reduced. Therefore, when it is worked into an ink ribbon with addition of a lubricant thereto, the running performance is improved, so that the necessary recording energy can be reduced, and images and/or dots can be printed in perfect shape, without any non-printed portions, on a recording sheet, without being affected by the smoothness of the surface thereof. Furthermore, when a lubricant is contained in the adhesive layer 5, the problem can be avoided that the surfaces of the ink ribbon adhere to each other when wound on a reel and stored in a place where the ambient temperature is relatively high. However, when the content of a lubricant is more than 10 parts by weight to 100 parts by weight of any of the above thermoplastic resins and/or any of the above thermofusible materials, the image fixing performance of the recording material is degraded, so that the background of the printed images becomes smeared by the ink during image transfer.

Examples of the lubricant for use in the adhesive layer 5 are surface active agents and organic sats which are solid or semi-solid at room temperature.

As such surface active agents, salts of carboxylic acids, salts of higher alcohol sulfuric ester, sulfontte, higher alcohol phosphoric ester, and salts thereof can be employed. Specific examples of such compounds are sodium laurate, sodium stearate, sodium oleate; sodium lauryl alcohol sulfuric ester, sodium stearyl sulfuric ester, and sodium oleyl alcohol sulfuric ester; sodium octyl sulfonate, sodium decyl sulfonate, sodium dodecyl sulfonate; and sodium phosphate monostearyl ester, and sodium phosphate distearyl ester.

As the organic salts, for example, metallic soaps such as aluminum stearate, calcium stearate, and magnesium stearate; and other salts such as hexylammonium chloride, sodium sulfosalicylate, sodium succinate, potassium succinate, potassium benzoate, and potassium adipate can be employed in practice.

It is essential that no pigments be contained in the adhesive layer 5 because if any pigment is contained, the adhesive force of the adhesive layer 5 is significantly decreased.

When a non-impact electrothermic recording material according to the present invention is prepared, electrconductive carbon black is dispersed in a resin such as aromatic polyamide, by use of an organic solvent such as dimethylforamide and dimethylacetamide, to prepare a dispersion. This dispersion is formed into a film by the conventional casting method, whereby an electroconductive resin film support is obtained. A metal is deposited in vacuum on the electroconductive resin film support, preferably aluminum at a vacuum degree of $10^{-4} \sim 10^{-5}$ Torr, whereby a metal film layer is formed on the electroconductive resin film support.

The thermofusible peel-off layer 3 and the thermofusible ink layer 4 are successively formed on the metal film layer 2 by the conventional hot-melt method or coating method using toluene, xylene or alcohols as a solvent, and the adhesive layer 5 is formed on the thermofusible ink layer 4 as shown in FIG. 1.

It is preferable that the thickness of the electroconductive resin film support 1 be in the range of $2 \sim 15$ μm, more preferably in the range of about $4 \sim 10$ μm, the thickness of the metal film layer 2 be in the range of about $40 \sim 200$ nm, the thickness of the thermofusible peel-off layer 3 be in the range of about $0.5 \sim 5$ μm, the thickness of the thermofusible ink layer 4 be in the range of about $3 \sim 10$ μm, and the thickness of the adhesive layer 5 be in the range of about $0.5 \sim 5$ μm.

Non-impact electrothermic image transfer recording by use of the thus prepared non-impact electrothermic image transfer recording material according to the present invention can be performed as follows:

The recording material is closely superimposed on a recording sheet 6 as shown in FIG. 2, with the adhesive layer 5 brought into close contact with the recording sheet 6, and a recording electrode 7 and a return electrode 8 are placed in contact with the electro-conductive resin film support 1 opposite to the thermofusible ink layer 4. An image-delineating signal voltage is then applied from an image signal voltage application apparatus 9 across the recording electrode 7 and the return electrode 8 through the electroconductive resin film support 1 and the metal film layer 2. When the electric current is caused to pass through the recording material, the electric current density becomes maximum immediately under the recording electrode 7 and the current flows through the metal film layer 2. Since the contact area of the return electrode 8 with the electroconductive resin film support 1 is much greater than the contact area of the recording electrode 7 with the electroconductive resin film support 1, the electric current density in the recording material decreases towards the return electrode 8. The result is that the peel-off layer 3 and the ink layer 4 right under the recording electrode 7 are respectively fused and softened or melted by the Joule's heat generated by this electric current, so that the softened or melted portion of the ink layer 4 is transferred imagewise to the recording sheet 6, corresponding to the image-delineating signals applied to the recording electrode 7, whereas no ink layer portions are transferred to the recording sheet 6 under the return electrode 8. By the adhesive layer 5, the ink layer 4 is transferred together with the adhesive layer 5 to the recording sheet 6.

The conditions of applying electric current to the recording material and the number of the scanning lines have significant effects on the image formation. Generally, in the present invention, the voltage of the image-delineating signals is in the range of 10 volts to 200 volts and the application time thereof is in the range of 0.05 msec to 1 msec, with the number of scanning lines being in the range of about 3 to 20 lines/mm.

Embodiments of a non-impact electrothermic image transfer recording material according to the present invention will now be explained in detail with reference to the following examples. These examples are given for illustration of the present invention and not intended to be limiting thereof.

EXAMPLE 1

A mixture of the following components was dispersed in a ball mill for 20 hours:

| | Parts by Weight |
|---|---|
| m-phenylenetelephthalimide | 85 |
| Electroconductive carbon | 15 |
| Dimethylformamide | 900 |

The above dispersion was applied to a glass plate by use of a blade with a gap between the glass plate and the blade set at about 200 μm and then dried at 110° C. for 1 hour in a dryer to form a film sheet on the glass plate. Thereafter, the film sheet carrying glass plate was immersed in cold water at about 5° C. for 1 minute and the film sheet was peeled off the glass plate. Thus, an electroconductive resin film support was obtained.

On this electroconductive resin film support, aluminum was deposited in vacuum at $10^{-5}$ Torr with a thickness of about 100 nm, whereby an aluminum film layer was formed on the electroconductive resin film support.

A mixture of the following components was dispersed to prepare a peel-off layer coating mixture. The mixture was coated on the aluminum film layer with a thickness of about 1 μm, whereby a thermofusible peel-off layer was formed on the aluminum film layer.

| | Parts by Weight |
|---|---|
| Ethylene - vinyl acetate copolymer (containing 90% of ethylene units, Melt Index: 480) | 15 |
| Polyethylene wax (m.p. 92° C.) | 85 |

A mixture of the following components was dispersed in a ball mill for 24 hours, whereby a thermofusible ink layer coating liquid was prepared:

| | Parts by Weight |
|---|---|
| Polystyrene resin (Trademark "HH102" made by Mitsubishi Monsanto Chemical Co., Ltd.: softening point 101° C., M.W. 55000) | 35 |
| Ethylene - vinyl acetate copolymer (containing 72% of ethylene units, Melt Index: 80) | 25 |
| Oxidized polyethylene (Acid Value 25, m.p. 98° C.) | 10 |
| Paraffin wax (m.p. 78° C.) | 20 |
| Carbon black (as coloring agent) | 10 |
| Toluene | 400 |

The thus prepared thermofusible ink layer coating liquid was applied to the thermofusible peel-off layer by a wire bar and dried by a dryer at 80° C. for 1 minute, whereby a thermo-fusible ink layer having a thickness of about 5 μm was formed on the peel-off layer.

A mixture of the following components was dispersed in a ball mill for 24 hours, so that an adhesive layer coating mixture was prepared.

| | Parts by Weight |
|---|---|
| Styrene - acryl copolymer (softening point: 90° C.) | 10 |
| Carbon black (as coloring agent) | 2 |
| Toluene | 188 |

The above adhesive layer coating mixture was coated on the thermofusible ink layer by a wire bar and dried at 100° C. for 1 minute, so that an adhesive layer having a thickness of about 2 μm was formed on the thermofusible ink layer. Thus, a non-impact electrothermic image transfer recording material No. 1 according to the present invention was prepared.

The non-impact electrothermic image transfer recording material No. 1 was superimposed on a sheet of plain paper having a surface smoothness of 3 seconds in terms of Bekk's smoothness. A recording electrode with multiple recording styli embedded therein in two rows in a zigzag shape, with the recording styli density being 8 styli/mm and each stylus having a diameter of about 60 μm and a return electrode were placed in contact with the recording material No. 1. Thereafter image-delineating signals of 12 V (resistance 0.5 kΩ), with a recording power of 0.3 W, were applied through the recording electrode, whereby image recording was performed. As a result, sharp images with a dot density of 1.4 and a resolution of 16 dots/mm were obtained on the plain paper.

It was tried to erase the thus obtained images with a clock meter with an ink eraser attached thereto 10 times. However, the images were not erased at all.

This recording material was worked into an ink ribbon and 5,000,000 characters were printed by use of the ink ribbon. However, the multiple recording styli were not worn away at all.

EXAMPLE 2

Example 1 was repeated except that the polystyrene resin (softening point 101° C., M.W. 55000) employed in Example 1 was replaced by a polystyrene resin (softening point 80° C., M.W. 30000), whereby a non-impact electrothermic image transfer recording material No. 2 according to the present invention was prepared.

The thus prepared non-impact electrothermic image transfer recording material No.2 was superimposed on a sheet of plain paper having a surface smoothness of 3 seconds in terms of Bekk's smoothness. Non-impact electrothermic recording was performed in the same manner as in Example 1, using the recording material in the form of a ribbon. As a result, sharp images with a dot density of 1.48 and a resolution of 16 dots/mm were obtained on the plain paper.

It was tried to erase the thus obtained printed images with the same clock meter as that employed in Example 1, but the images were not erased at all.

By using the ink ribbon, 5,000,000 characters were printed. However, the multiple recording styli were not worn away at all as in Example 1.

The non-impact electrothermic image transfer recording materials according to the present invention are thin, compact and capable of yielding clear images on a recording material without being affected by the smoothness of the recording material. Furthermore, when necessary, printing with other colors than black may be performed.

Further, the non-impact electrothermic image transfer recording materials according to the present invention can attain sharp transfer of ink images with application of a relatively low recording energy and extend the life of recording styli as compared with the conventional life thereof, thus attaining reliable recording.

What is claimed is:

1. A non-impact electrothermic image transfer recording material comprising an electroconductive resin film support, a metal film layer formed thereon, a thermofusible peel-off layer formed on said metal film layer comprising a wax melting at 120° C. or less and a resin compatible with said wax, said thermofusible peel-off layer becoming a liquid of low viscosity upon heating, a thermofusible ink layer formed on said thermofusible peel-off layer, and an adhesive layer comprising a thermoplastic resin formed on said thermofusible ink layer.

2. The non-impact electrothermic image transfer recording material as claimed in claim 1, wherein said electroconductive resin film support comprises as the main components a polyamide resin and an electroconductive carbon black.

3. The non-impact electrothermic image transfer recording material as claimed in claim 1, wherein the thickness of said electroconductive resin film support is in the range of 2 to 15 μm.

4. The non-impact electrothermic image transfer recording material as claimed in claim 1, wherein said metal film layer is an aluminum deposited layer.

5. The non-impact electrothermic image transfer recording material as claimed in claim 1, wherein the thickness of said metal film layer is in the range of 40 nm to 200 nm.

6. The non-impact electrothermic image transfer recording material as claimed in claim 1, wherein said thermofusible ink layer comprises as the main components a polystyrene resin having a softening or melting point of 70° C. to 140° C. and a molecular weight ranging from 10,000 to 70,000 and a coloring agent.

7. The non-impact electrothermic image transfer recording material as claimed in claim 1, wherein said adhesive layer further comprises a lubricant in an effective amount.

8. The non-impact electrothermic image transfer recording material as claimed in claim 1, wherein said thermoplastic resin having a softening or melting point of 70° C. to 140° C.

9. The non-impact electrothermic image transfer recording material as claimed in claim 1, wherein said adhesive layer comprises a thermofusible material selected from the group consisting of phenol derivatives, naphthol derivatives, aromatic carboxylic acid derivatives and fatty acid amide derivatives.

* * * * *